United States Patent [19]

Ammon et al.

[11] Patent Number: 4,586,254

[45] Date of Patent: May 6, 1986

[54] METHOD OF MAKING A MODULAR CONNECTOR

[75] Inventors: J. Preston Ammon; Jerry A. Kendall, both of Dallas; John D. Martens, Carrollton, all of Tex.

[73] Assignee: Elfab Corp., Lewisville, Tex.

[21] Appl. No.: 693,637

[22] Filed: Jan. 22, 1985

Related U.S. Application Data

[62] Division of Ser. No. 520,868, Aug. 5, 1983, abandoned.

[51] Int. Cl.[4] ..... H01R 43/16

[52] U.S. Cl. ..... 29/884; 339/17 L; 339/176 MP

[58] Field of Search ..... 29/884, 845; 339/221 M, 339/217 S, 176 M, 17 L

[56] References Cited

U.S. PATENT DOCUMENTS

| | | | |
|---|---|---|---|
| 3,601,770 | 8/1971 | Bowley | 339/17 L X |
| 4,026,014 | 5/1977 | Sugimoto et al. | 29/884 |
| 4,045,868 | 9/1977 | Ammon et al. | 29/845 |
| 4,077,694 | 3/1978 | CoBaugh et al. | 339/176 MP |
| 4,166,667 | 9/1979 | Griffen | 339/221 R X |
| 4,169,649 | 10/1979 | Henley et al. | 339/176 M |
| 4,190,952 | 3/1980 | Thomas et al. | 29/845 |
| 4,480,885 | 11/1984 | Coppelman | 29/845 X |

OTHER PUBLICATIONS

IBM Tech. Disclosure Bull., vol. 15, No. 1, Jun. 1972, p. 108, by Dust.

*Primary Examiner*—Howard N. Goldberg
*Assistant Examiner*—Carl J. Arbes
*Attorney, Agent, or Firm*—John E. Vandigriff

[57] ABSTRACT

A modular printed circuit card edge connector or a cable connector plug is made in several parts including the connector body, a bottom plate, two separate end caps and a plurality of connector terminals. The body of the connector can be cut to any length and assembled with the other parts to provide a card edge connector or cable connector of a desired length. In a second embodiment of the invention, a press fit connector is made up of the modular parts. The base plate is not used and the body of the connector is used to press fit the terminals into a circuit board.

4 Claims, 27 Drawing Figures

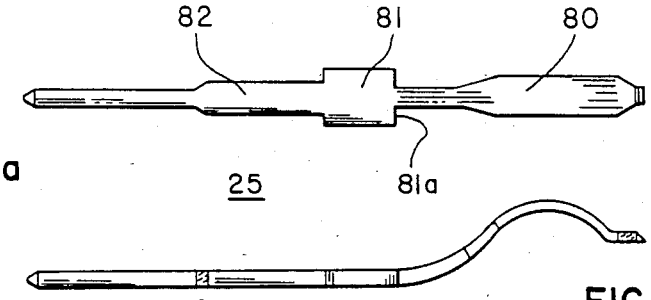
FIG. 8a
FIG. 8b
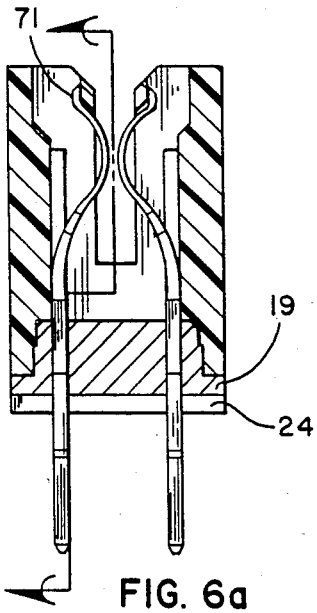
FIG. 6a
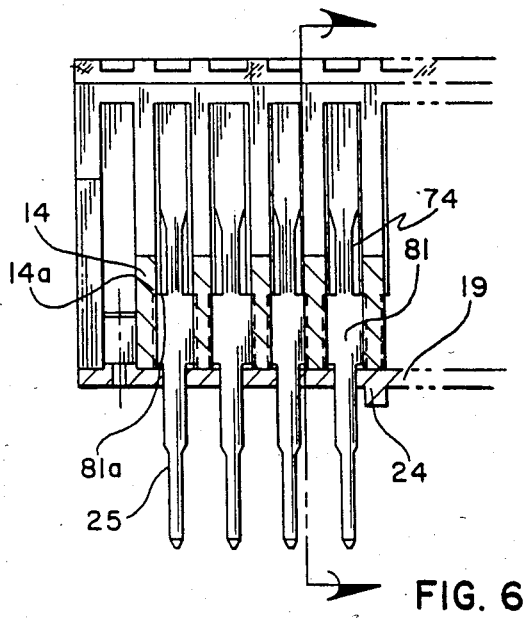
FIG. 6b
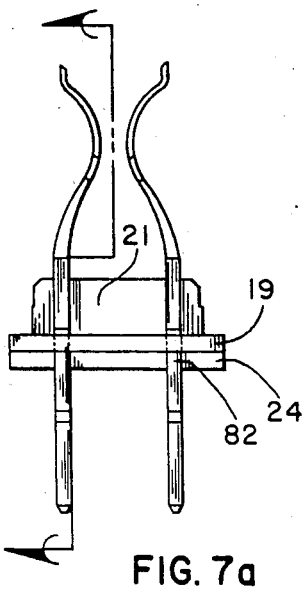
FIG. 7a
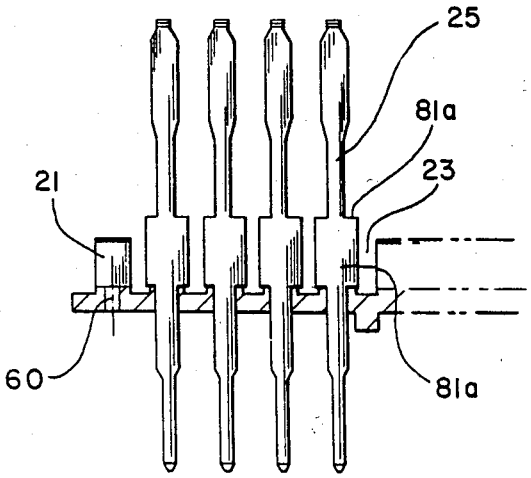
FIG. 7b

METHOD OF MAKING A MODULAR CONNECTOR

This is a division of application Ser. No. 520,868, filed Aug. 5, 1983, now abandoned.

BACKGROUND OF THE INVENTION

1. Field of the Invention

This invention relates to connectors and more particularly to a modular connector that can be customized as to length by cutting an insulator body thereof to the desired length and then assembling the insulator with other parts to complete the connector.

2. Description of the Prior Art

In general, prior art connectors have been assembled by molding connectors into a body of insulating material which forms a structural member to support the contacts and hold them rigidly within the insulating body. Other connectors may have the connectors press fitted into the insulating material body or press fitted into a printed circuit board with the insulating material body fitted over the contacts and the body secured to the printed circuit board with screws or rivets. Still other connectors may utilize a combination of the above features. Regardless of how the connector is structured or assembled, the length of the body of the connector and the number of contacts in the body is a fixed number for each specific application. If an equipment manufacturer utilizes a large number of connectors of various lengths (a different number of contacts), then a large variety of connectors must be stocked.

Connectors representative of the prior art are described in U.S. Pat. Nos. 3,671,917, 4,035,047 and 4,094,573.

In U.S. Pat. No. 3,671,917, contact terminals are inserted into a substrate by press fitting the contact terminals into the substrate and then attaching an insulating housing over the contact terminals. The housing comprises an outer shell open at the bottom to permit it to be placed over and enclose the contact terminals. This connector depends upon the printed circuit board to serve as one enclosing surface for the connector.

Another prior art connector is found in U.S. Pat. No. 4,035,047. In this patent the connector is not a card edge connector, but is used with another connector. The contact terminals are press fitted into the mounting substrate and then the housing is pressed over the terminals and engage the terminals in a press fit relationship.

In U.S. Pat. No. 4,094,573, the terminal contacts are press fitted into the substrate, but the housing is held in place by the contact terminals. Each terminal has a tongue that is depressed while the housing is being put into place and then springs into a recess in the housing and engages a shoulder on the housing, holding it in place against the substrate.

U.S. Pat. No. 4,220,393, each contact has a press fit collar formed on the contact and the connector insulator body serves as the seating tool. The contacts are held in place by the insulator and are simultaneously press fitted into the substrate by continuously applying pressure to the top of the insulator until each contact is in place.

In each of the above references, the housing is of a fixed length and cannot be modified to hold a lesser number of contact terminals. This inability to modify the number of contact terminals requires the circuit board manufacturer to stock a large number of connectors to ensure that a connector of the correct length and number of contact terminals is on hand and available when needed. In U.S. Pat. No. 4,220,393, the contacts are pressed into place by the insulator but it is required that the contact have a press fit collar thereon. Also the insulator is not adaptable as to size.

SUMMARY OF THE INVENTION

The invention is a modular socket or connector made up of standard parts that can be assembled to make connectors of different lengths. The connector includes a body part that can be cut at intervals to the desired length. Repeating sections in the body accept terminals that extend through the body part and are held in place by a bottom plate in conjunction with the body. End caps are place on each end to close the ends of the body, and in some configurations, secure the connector to a printed circuit board with screws or rivets.

The insulator is versatile in that it can be used with more than one type of contact and can be used with or without a bottom plate depending upon whether it is to be used as an assembled connector or whether the insulator is to be used as the connector housing and as a tool to press the contacts into a circuit board.

In order to make a connector of a desired size, the body insulator is cut at a specific location at one of the repeating sections. The cut end is then milled with a simple end mill tool to provide an opening that mates with the end cap. The connector parts are then snapped together and remain in place by frictional forces. The same insulator and end caps can be used in either configuration, a press fit connector, a card edge connector with solder or wire wrap terminals.

THE DRAWINGS

FIG. 1 is an exploded view of the modular connector illustrating the individual parts of the connector;

FIGS. 2*a*, 2*b* and 2*c* illustrate three different end caps for the connector;

FIGS. 3*a*, 3*b*, 3*c* and 3*d* illustrate the bottom plate of the connector;

FIGS. 4*a*, 4*b*, 4*c* illustrate the body of the connector;

FIGS. 5*a*, 5*b*, 5*c* illustrate the end of the body before and after the end of the body has been cut and milled;

FIGS. 6*a* and 6*b* illustrate a section of the body showing the contact terminals;

FIGS. 7*a* and 7*b* illustrate the contact terminals in the base plate;

FIG. 8*a* is a front view of a single contact terminal;

FIG. 8*b* is a side view of the single contact terminal;

FIG. 9 illustrates a tool for cutting a connector to a desired length and for preparing the cut end to accept an end cap;

FIG. 10*a* is a from view of a single terminal to be used with a press fit insulator;

FIG. 10*b* is a side view of the terminal of FIG. 10*a;*

FIGS. 11*a* and 11*b* illustrate a section of the insulator body showing the placement of the contact terminals;

FIG. 12*a* is a sectional end view of the insulator as in FIG. 11*a* with out the terminals; and FIG. 12*b* is a bottom view of the insulator without terminals.

DESCRIPTION OF A PREFERRED EMBODIMENT

Figure 1:
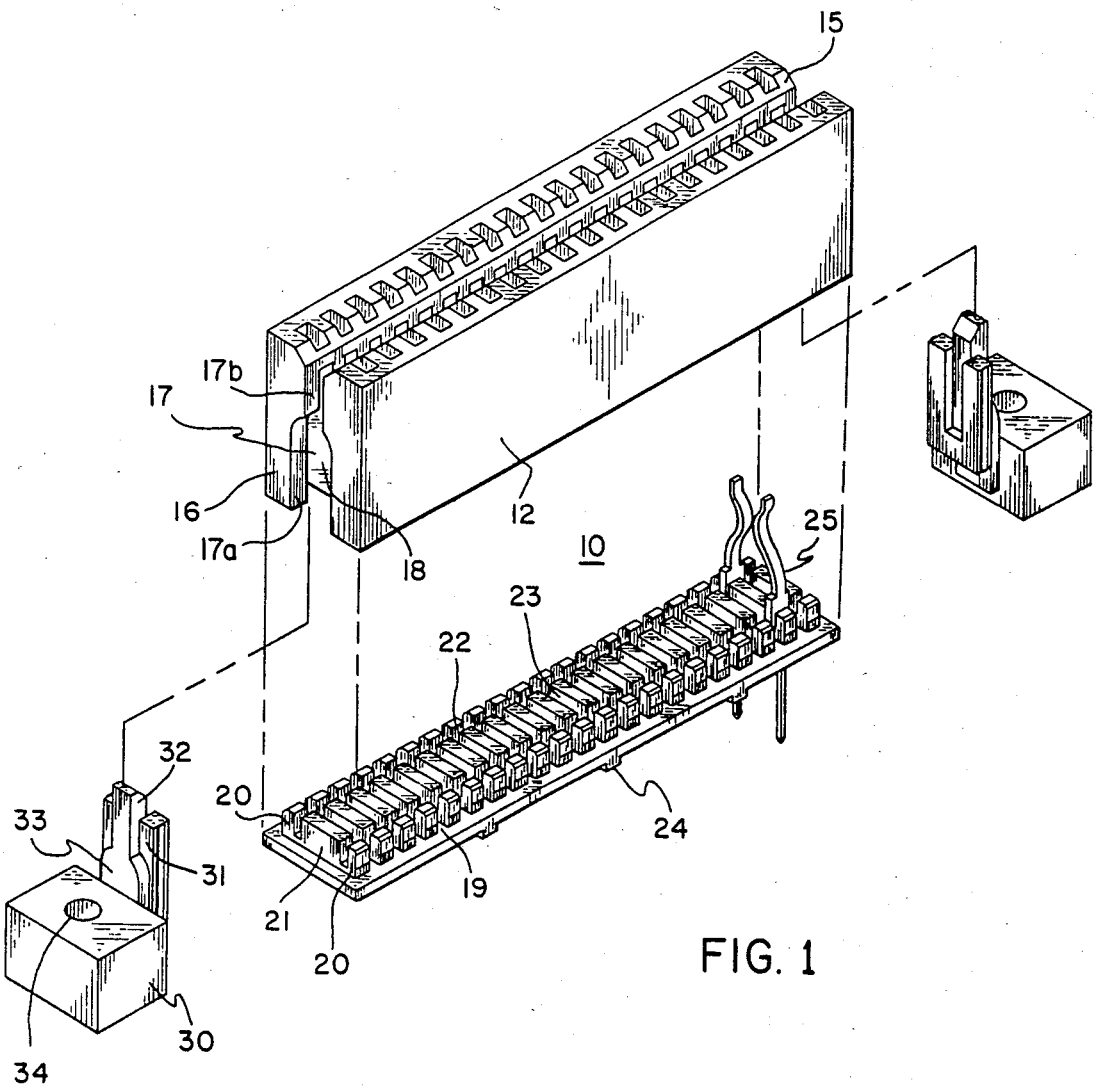

FIG. 1 illustrates the different parts of the modular connector 10. The body 12 is generally rectangular and has a plurality of identical compartments extending from one end to the other. Each end has an opening therein to receive an end cap. The opening 17 is wide at one end 17*a* and narrow at the other end 17*b*. The narrow end 17*a* and the wider end 17*a* match similarly shaped portions of the end caps 30. Each compartment in the body 12 is separated from the other by walls 18.

The end cap 30 slides into the end of the body 12. The vertical plate 31 on end cap 30 slides into the end compartment between end wall 16 and compartment wall 18. The opening at 17*a* is closed by ridge key 32 of end cap 30 and the opening 17 is closed by key 33. After the end cap is properly placed in the end of the body 12, the body end is closed, providing a mounting means for the connector via hole 34 in the end cap 30. With an end cap on each end of the connector body, the connector may be secured to a printed circuit board with screws or rivets.

Connector bottom plate 19 is positioned in the lower part of the body part 12. The bottom plate has a number of raised ridges 20 and 21 extending the length of the bottom plate. The ridges are spaced so that they fit into the compartments in the body 12. The space 23 between ridges provide spaces to receive the walls between the compartments in the body.

Contacts 25 are placed in the openings 22 between ridges 21 and 20 and are held in place as hereinafter explained.

Figure 2A:
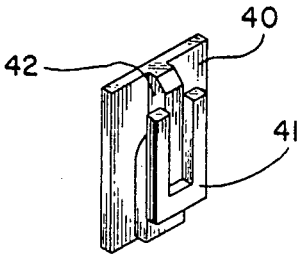
Figure 2B:
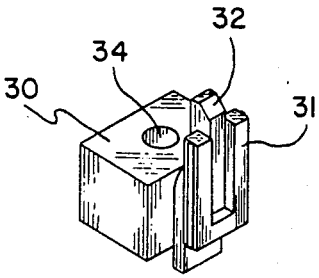
Figure 2C:
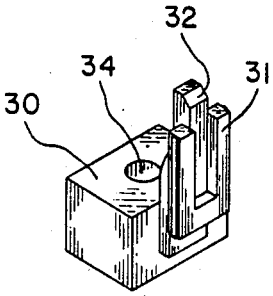

Different end caps may be used with the connector. Three variations are illustrated in FIGS. 2*a*, 2*b* and 2*c*. FIG. 2*a* illustrates an end cap to be used with a cable connector which is not to be connected to a printed circuit board or a press fit connector. There is no provision on end cap FIG. 2*a* for securing the connector to a surface. The plate 41 is positioned into the end of the body 12 between compartment wall 18 and end wall 16. The ridge part 42 matches the opening 17*a* and the end plate 40 enclosed and provides an end closure of the connector body. The end cap in FIG. 2*a* would be used, for example, with the press fit insulator described below.

The end caps in FIGS. 2*b* and 2*c* are essentially the same except that the body 30 is positioned higher with respect to the plate 31 in one embodiment than it is in the other.

While only three two contact terminals 25 are illustrated, there will be a terminal in each of the openings 22 along the length of the bottom plate.

After all the terminals are in place, and the end caps have been properly placed on each end of body 12, body 12 will be placed over the bottom plate, with the terminals extending up through the body, one pair of opposing terminals in each body compartment.

The connector assembly is completed by snapping the bottom plate 19 into the bottom of body 12. The connector is held together by frictional mating surfaces, hereinafter explained in detail.

Figure 3C:
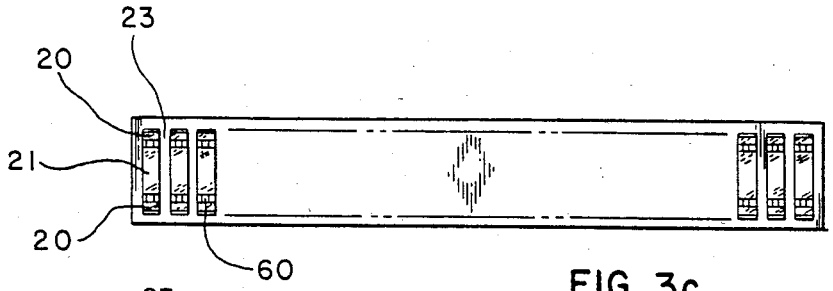
Figure 3D:
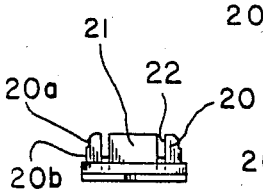
Figure 3B:
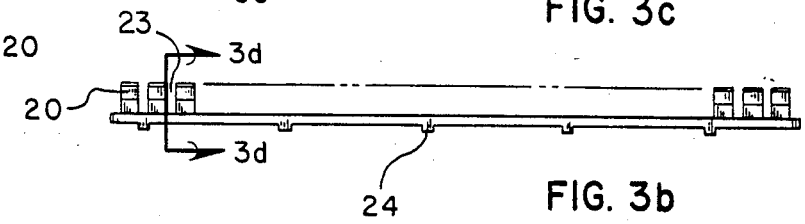
Figure 3A:
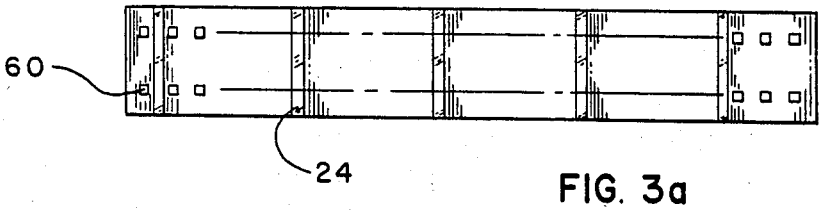

FIGS. 3*a*, 3*b*, 3*c* and 3*d* illustrate different views of the bottom plate 19. In FIG. 3*a* a bottom view of the bottom plate shows the cross support members 24 and the holes 60 through which the contact terminals 25 (not shown) extend.

The side view 3*b*, illustrates the ridges 20 and the openings 23 which separate the ridges 20 and 21. The end view 3*d* gives a clearer illustration of the ridges 20 and 21 separated by the openings 22. Each of the outer shoulder of ridges 20 have a rounded shoulder 20*a* and an enlarged shoulder 20*b*. The rounded area 20*a* permits easy insertion of the base plate 19 into the bottom of connector body 12, and the enlarged shoulder frictionally engages the inside of the side wall of body 12 to hold the bottom plate in position.

FIG. 3*c* is a top view of the bottom plate 19. Of particular note in this view are the holes 60 through which the contact terminals 25 extend. The holes 60 are centered in the openings 22 between the ridges 20 and 21.

FIG. 3*d* is a section taken through 3*d*—3*d* of FIG. 3*b*.

Figure 5A:
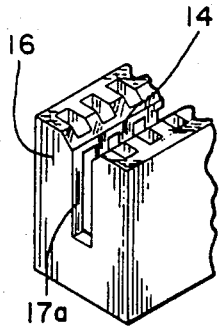
Figure 4C:
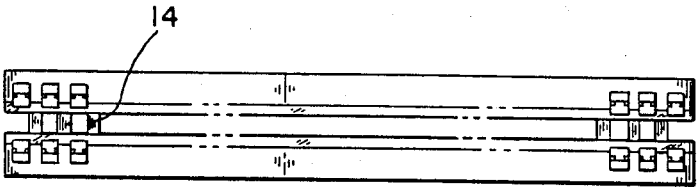
Figure 5B:
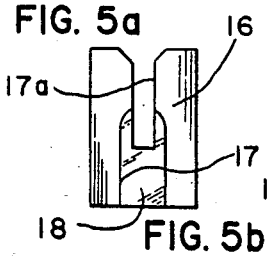
Figure 4B:
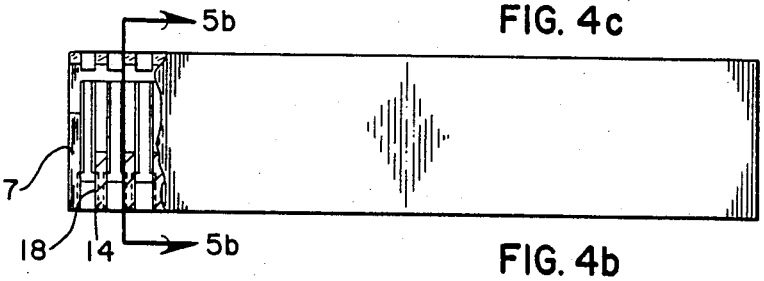
Figure 4A:
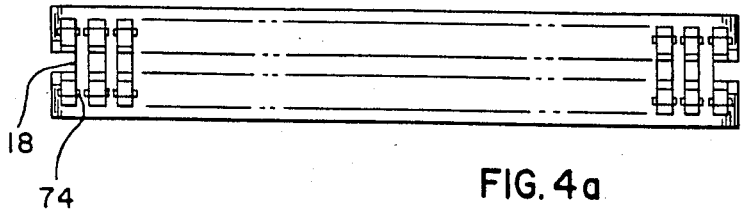

The top, side and bottom views of the connector body are illustrated in FIGS. 4*a*, 4*b* and 4*c*. The side view is shown in partial section and Section 5*b*—5*b* illustrates where the connector body would be cut in relation to the internal compartments and walls to make a connector of the desired length. FIG. 5*b* is taken through section 5*b*—5*b*.

The side view, FIG. 4*b*, illustrates the internal walls 14 of the body 12, the face of which is designated 18. The cut line 70 is made along the face 18 of one of the walls 14. After the cut, the end of the connector body will be as illustrated in FIG. 5*a*. The end 16 was originally a face 18 of wall 14.

The top view of the connector body, FIG. 4*c*, shows the internal support wall extending across the connector body. The bottom view, FIG. 4*a*, of the connector body, further shows protrusions 74 extending out from the surface 18 of the transverse wall 14. The protrusions frictionally contact with the contact terminal 25 when the connector is assembled as hereinafter explained.

Figure 5C:
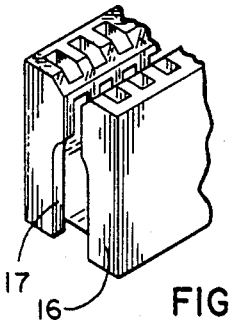

FIGS. 5*b* and 5*c* show the end of the connector body after the end 16 has been milled to opening 17 so that an end cap, such as those illustrated in FIGS. 2*a*, 2*b* and 2*c*, may be mounted onto the end of the connector.

In FIGS. 6*a* and 6*b* is illustrated part of an assembled connector showing the contact terminals as they are positioned in the compartments within the connector body.

FIGS. 7*a* and 7*b* illustrate the contact terminals positioned in the base plate 19, and FIGS. 8*a* and 8*b* illustrate a typical contact terminal.

The contact terminal 25 has at the midsection thereof shoulders 81 that are used to hold and stabilize the terminal when the connector has been assembled. As shown in FIG. 7*b*, the shoulders 81 extend past the ridges 21 into the opening 23 between the ridges 21. When the connector is assembled as illustrated in FIG. 6*b*, the protrusions 74 on transverse walls 14 engage the contact terminals at shoulders 81*a* and prevent movement of the terminals in a direction along the length of the connector. The terminals 25 are stabilized in the direction across the connector by the ridges 20 and 21. As illustrated in FIG. 7*a*, the connector terminal 25 is positioned in the opening 22 between the ridges 20 and 21 to prevent movement of the terminal in a direction transverse to the length of the connector.

The terminals are also secured in the bottom plate by the portion 82 of the connector. The area 82 of the connector is slightly larger than the opening 60 in the bottom plate 19 so that when the terminal 25 is pulled down into the opening 60, the contact area 82 frictionally engages the sides of the openings 60 and is held firmly within the opening.

The terminals are additionally stabilized and firmly held in the connector body 12 by virtue of the fact that the area 80 of the connector is curved and presses against the side wall 71 of the compartment of the body in which it resides. The general positioning of the terminal is illustrated in FIGS. 6*a* and 7*a*.

Figure 10A:
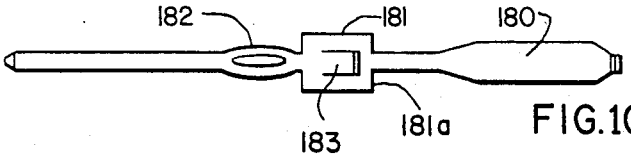
Figure 10B:
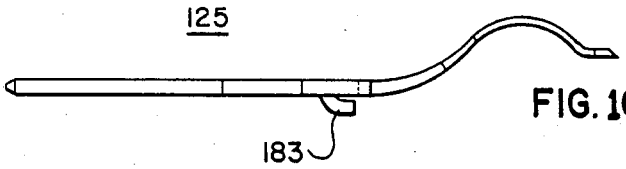

FIG. 10 illustrates a contact terminal to be used when the insulator body is used for a press fit connector. Terminal 125 is similar to terminal 25 illustrated in FIG. 8*b*. Terminal 125 has a similar top portion 180 and intermediate portion 181, however terminal 181 has a partially punched out region 183 that is used in the press fit mounting of the connector.

Terminal 125 also has a compliant region 182. Region 182 is that part of the terminal that is press fitted into a circuit board.

Figure 11A:
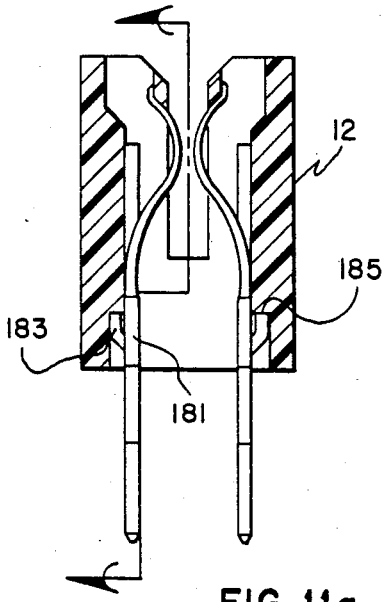
Figure 11B:
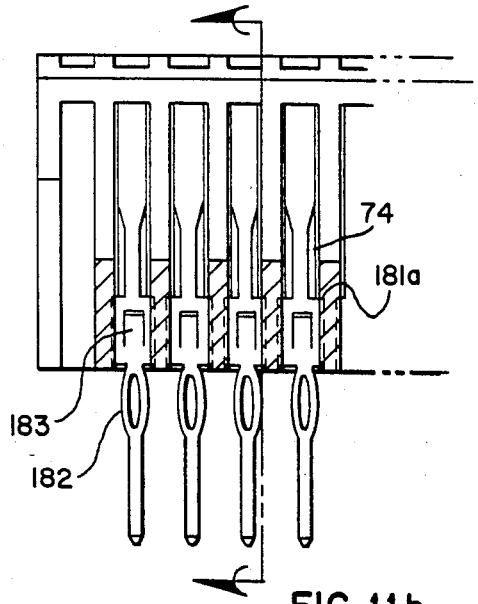

FIGS. 11*a* and 11*b* *illustrate terminal 125 positioned in the insulator body 12. The end of region 183 abutts the shoulder 185. It is the pressing of shoulder 185 against part 183 and projection 74 pressing against shoulder 181a* of terminal 125 that presses the terminals 125 into a circuit board on which the connector is to be mounted.

Figure 12A:
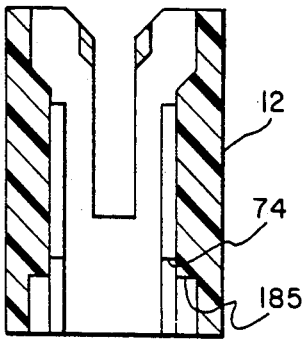
Figure 12B:
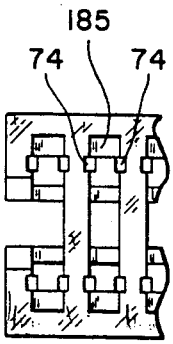

FIGS. 12*a* and 12*b* are respectively an end view of the insulator and a bottom view of the insulator without terminals. These views illustrate the shoulders 185 and 74 which are use to press fit the terminals into a printed circuit board.

In another embodiment of the invention a solder tail terminal is used. The terminal (not illustrated) is similar to the terminal illustrated in FIG. 10. The solder tail terminal would not have the complaint region 182 of terminal 125, but is straight from intermediate region 181 to the end of the terminal. The insulator for the solder connector is the same as for the above described connector. The end cap illustrated in FIG. 2*c* is used.

A bottom plate need not be used. The end cap holds the insulator body above the surface of the printed circuit board on which the connect is to be mounted so that it will not interfere with solder flow during the flow solder procedures used to bond the solder tail terminal to the printed circuit board. In the event, for some reason, a bottom plate is used with the solder tail connector, then the transverse ridges 24 on the bottom plate holds the connector above the printed circuit board to allow for solder flow.

From the above description of the invention it may be seen that a modular connector can use the same insulator body and end caps to make up a press fit connector or a connector to be mounted on a printed circuit board using solder, screw or rivet means to mount the connector. The only variation between the two type connectors is that a different terminal contact is used and that a bottom plate is not used with the press fit connector since the circuit board on which it is mounted is used as the bottom plate.

Each of the above described connectors may be repaired in the event a terminal is damaged. The insulator body only frictionally engages the terminals so it may be lifted off the terminal, the damaged terminal replaced, and the insulator placed over the terminals and pressed into engagement with the terminal.

With the versatility of the connector embodiment of the present invention, connectors of different lengths and mounting methods can be made up of a few standard parts eliminating the need for a large variety of different connectors.

Figure 9:
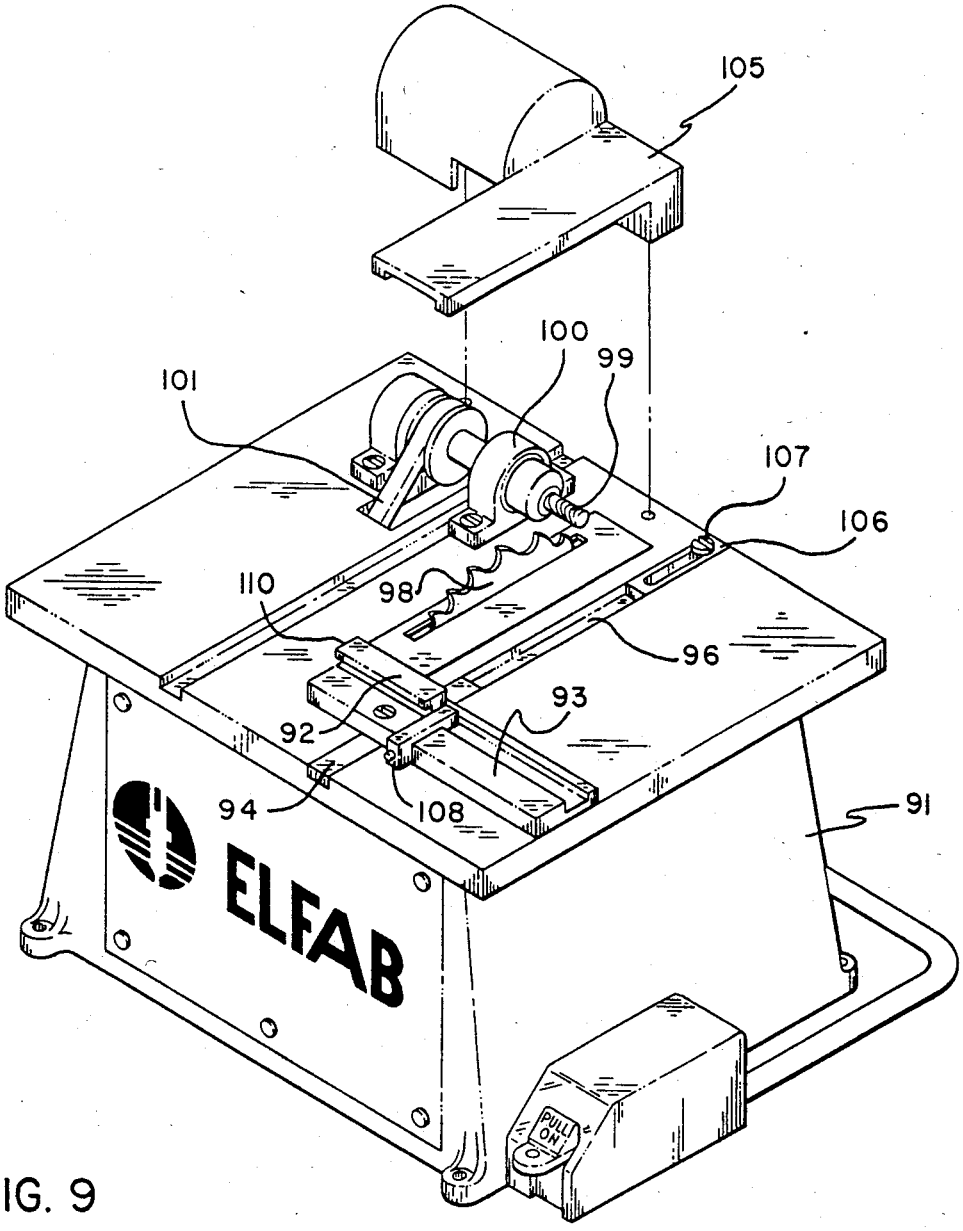

A tool for cutting a connector to the desired length and for milling the cut end to receive an end cap is illustrated in FIG. 9. A connector body 92 is placed on the carrier 93 and indexed to the corrected position by stop 108. Carrier 93 has a sliding member 94 that slides in groove 96. As the carrier 93 is moved toward blade 98, the connector body 92 is cut to the desired length. Carrier 93 is moved past blade 98 so that the cut end 110 of the connector body is milled to form the opening 17 as illustrated in FIG. 5*c*. The opening is milled to the correct depth by setting stop 106 which may be adjusted by set screw 107.

Both the saw 98 and the mill 99 may be turned by the same motor (not shown). The motor drives the saw blade and mandrel 100. Mandrel 100 is powered by belt 101. A protective cover 105 covers both the saw blade 98, the mandrel 100 and the mill 99.

It is to be understood that the forms of the invention shown and described are preferred embodiments thereof and that various changes may be made in detained configurations thereof and in proportional size of the various parts thereof without departing from the spirit and scope of the invention.

What is claimed is:

1. A method of making a connector to a desired length from modular parts including a connector body having a plurality of identical compartments formed by transverse walls within the connector body, a bottom plate, two end caps and a plurality of terminals, comprising the steps of; cutting the connector body adjacent to one of the transverse walls to provide a connector body of the desired length and milling a slot in the cut end of the connector body, joining an end cap to each end of the connector body, and joining the bottom plate to the connector body, the bottom plate having a plurality of terminals extending through the bottom plate so that one end of each terminal is positioned within the connector body, and joining an end cap to each end of the connector body.

2. The method according to claim 1, wherein the milled slot has a rounded end to match with a rounded ridge key on the end cap.

3. The method according to claim 1 wherein the assembly of the connector is by frictionally engaging the connector parts to hold the connector together.

4. A method of making a connector to a desired length from modular parts including a connector body having a plurality of identical compartments formed by transverse walls within the connector body and having shoulder regions within each compartment, two end caps and a plurality of terminals, each terminal having a punched out region, and joining the connector to a circuit board, comprising the steps of; cutting the connector body, if necessary, adjacent to one of the transverse walls to provide a connector body of the desired length and milling a slot in the cut end of the connector, and pressing the terminals into the circuit board using the shoulder regions of the connector body to press against the punched out region of the terminal to seat the terminal in the circuit board and to hold the connector thereto.

* * * * *